US006283189B1

(12) United States Patent
Liebscher

(10) Patent No.: US 6,283,189 B1
(45) Date of Patent: Sep. 4, 2001

(54) SWINGING FOLDING DOOR AND A SWINGING FOLDING GATE; AND A SWINGING FOLDING DOOR WITH AN EMERGENCY OPENING DEVICE AND A SWINGING FOLDING GATE WITH AN EMERGENCY OPENING DEVICE

(75) Inventor: Arne Liebscher, Menden (DE)

(73) Assignee: DORMA GmbH + Co. KG, Ennepetal ( * ) Notice: Subject to any disclaimer, the term of this patent is extended or adjusted under 35 U.S.C. 154(b) by 0 days.

(21) Appl. No.: 09/132,063

(22) Filed: Aug. 17, 1998

Related U.S. Application Data

(63) Continuation-in-part of application No. PCT/EP97/06805, filed on Dec. 5, 1997.

(30) Foreign Application Priority Data

Dec. 18, 1996 (DE) ..... 196 52 600

(51) Int. Cl.[7] ..... E05F 15/20

(52) U.S. Cl. ..... 160/9; 160/2; 160/118; 160/188; 49/379

(58) Field of Search ..... 160/188, 189, 160/199, 206, 213, 2, 9, 118; 49/1, 4, 5, 6, 140, 141, 386, 379, 333, 334

(56) References Cited

U.S. PATENT DOCUMENTS 1,356,118 * 10/1920 Anderson ..... 49/379
1,773,124 * 8/1930 Sykes ..... 49/379
1,807,121 * 5/1931 Loeffler ..... 49/379
3,792,556 * 2/1974 Anghinetti et al. ..... 49/379
4,427,049 * 1/1984 Belanger et al. ..... 160/199
4,957,600 * 9/1990 Carlson et al. ..... 160/199
5,036,620 * 8/1991 Beran et al. ..... 49/141
5,392,834 * 2/1995 Borgerdt ..... 160/118
5,398,448 * 3/1995 Kallfass ..... 49/379
5,560,658 * 10/1996 Coolman et al. ..... 292/28
5,809,697 * 9/1998 Chen ..... 49/379

FOREIGN PATENT DOCUMENTS 1814224 6/1970 (DE) .
2829912 1/1980 (DE) .
3202930 8/1983 (DE) .
8806426 9/1988 (DE) .
4014727 12/1990 (DE) .

* cited by examiner

*Primary Examiner*—Daniel P. Stodola
*Assistant Examiner*—Curtis A. Cohen
(74) *Attorney, Agent, or Firm*—Nils H. Ljungman & Associates

(57) ABSTRACT

An emergency opening device for a swinging folding door or a swinging folding gate, using an electric motor drive with a switchable electromagnetic coupling for closing and opening the door panels. The door has an emergency opening device, whereby the emergency opening device consists of an elastic tension or compression device to which a pre-load can be applied during the closing of the door. The tension or compression device can be engaged in the drive shaft of the outer panel or in the vicinity of the main closing edge of the inner panel.

12 Claims, 6 Drawing Sheets

SWINGING FOLDING DOOR AND A SWINGING FOLDING GATE; AND A SWINGING FOLDING DOOR WITH AN EMERGENCY OPENING DEVICE AND A SWINGING FOLDING GATE WITH AN EMERGENCY OPENING DEVICE

CONTINUING APPLICATION DATA

This application is a Continuation-In-Part application of International Application No. PCT/EP97/06805, filed on Dec. 6, 1997, which claims priority from Federal Republic of Germany Patent Application No. 196 52 600.0, filed on Dec. 18, 1996. International Application No. PCT/EP 97/06805 was pending as of the filing date of the above-cited application. The U.S. was an elected state in International Application No. PCT/EP 97/06805.

BACKGROUND OF THE INVENTION

1. Field of the Invention

The present invention relates to a swinging folding door or gate with an emergency opening device or an emergency opening device for a swinging folding door or a swinging folding gate which has at least one outer and one inner panel. At least two panels can be connected to one another by means of a pivoting drag link. An outer panel can be guided in a restricted manner in a hinge which is located on the door frame or in a similar location, and the free end of an inner door panel, which inner door panel has a main closing edge, is guided in a restricted manner in or on the door frame or case, on the transom or crossbar or in a similar location by means of a folding linkage.

2. Background Information

German Patent Specification 18 14 224 discloses a multi-panel swinging folding door on which the outer door panel is driven by means of a four-hinge transmission, the propeller shaft of which does not coincide with the axis of rotation, i.e. with the supporting bearing or journal bearing of the outer door panel. In the vicinity of the connection of the individual door panels there is a folding linkage, which folding linkage is responsible for the parallel orientation of the individual door panels in relation to one another when the swinging folding gate is open. There is no emergency opening device.

German Unexamined Patent Application 40 14 727, filed by the applicant, describes an automatic sliding door that consists of two door panels that can move in opposite directions and are guided on rails located on the transom. The door panels are driven by an electric motor with an electromagnetic coupling or clutch. When the door panels are closed, an elastic tension device or auxiliary drive, which elastic tension device can be realized in the form of a rubber element, is stretched so that in the event of a power failure or disconnection, at which time the coupling or clutch is opened, the sliding door is automatically opened, to keep the escape and evacuation route in which such a door is installed unobstructed, even under hazardous conditions.

German Unexamined Patent Application 28 29 912 describes a folding door in which the drive of the folding door panel is in the form of a motor that acts on the band journal or pin of a joint hinge, whereby an elastic coupling is located between the motor and the joint hinge to achieve a more favorable closing and opening action. In the gear train of the drive mechanism, there is also a rapid release capability which makes it possible to operate the door by hand.

German Patent Specification 32 02 930 relates to an electromagnetic drive system for swinging panels of doors or similar systems in which a direct current motor located in a housing acts through an intermediate, heavily geared planetary gear train on the articulated lever-like linkage that actuates the swinging panel. The output shaft of the gear train is mounted in the base and carrier plate of the housing so that the linkage can be connected on both sides to the output shaft, if necessary. On the side of the output shaft opposite the linkage, there is a return spring assembly which, when the motor is de-energized, rotates the output shaft to close the door panel. This is not a emergency opening device of the type described above, but an automatic door closer. Nor does the linkage disclosed by the above-referenced patent itself form the drive shaft and thus the hinge of the door panel.

OBJECT OF THE INVENTION

The object of the present invention, on a folding door or a folding gate of the type described above, is to create an emergency opening device, by means of which it is possible, using the simplest possible construction, to reliably initiate the folding process of the individual door panels in the opening direction. Because the opening and closing of such doors generally uses appropriate drive structure, i.e. the doors are not opened and closed manually, and the drive must conventionally be supplied with electrical energy, in this context the term "emergency" is used to mean in particular a situation in which the electrical energy required for the opening process fails or in which an alarm device or the actuation of a manual switch gives a command to open the doors to clear the escape and evacuation route, for example in case of fire or other eventually. A component of the present invention is therefore a drive system that is realized in the form of an electric motor drive, whereby the electric motor has an electromagnetic coupling which is automatically released in the event of a power failure. In this case, it must be taken into consideration, in particular, that the emergency opening device can be designed so that it has sufficient capacity to apply the relatively large moment required at the beginning of the folding process to initiate the folding of the door.

SUMMARY OF THE INVENTION

The present invention teaches that this object can be accomplished by using the hinge to form the drive shaft of the outer door panel. The drive system for the opening and closing of the door panels comprises an electric-motor drive with a switchable electromagnetic coupling. An emergency opening device of an elastic tension or compression structure, for example a leg spring mechanism 12, flat coil spring 15, torsion spring 19, or linear spring element 22, that can be stretched during the closing of the swinging folding door and is engaged in the drive shaft of the outer door panel or in the vicinity of the main closing edge o the inner door panel. For ease of understanding, the following description relates exclusively to a swinging folding door, although the invention can be used just as well on a swinging folding gate. When the tension or pressure means are located immediately in the drive shaft or in the vicinity of the main closing edge of the inner door panel, it is possible, using a simple construction, to exert a sufficient return force on the door panels without thereby incurring large losses. It is also possible to omit the components for the emergency opening process that project outward or inward beyond the door panels into the passage area.

In one preferred embodiment, a leg spring mechanism is provided which—when it is realized in the form of a torsion spring, for example—is located inside the drive shaft of the outer door panel, which drive shaft can be located on the door frame or in a similar location. When a torsion spring, a flat coil spring etc. is used, for example, the leg spring mechanism can alternatively be oriented concentric to the drive shaft of the outer door panel, which drives shaft is located on the door frame or in a similar location.

In an additional configuration of the invention, the drive shaft has a winding roller that is non-rotationally connected to it, and by which it guides a linear tension device that is connected on the other and to a transom or a similar location. By use of the linear tension device, the strength of which can be selected to meet the specific requirements, and which can consist of a cable to which tension is applied by a flat coil spring, a sufficiently large moment can be exerted on the drive shaft of the outer door panel in the opening direction.

In at least one embodiment of the present invention, the coupling point of the outer door panel to the drive shaft lies outside the drive shaft, so that when the swinging folding door is being opened or closed, the coupling point of the outer door panel runs in an orbit, i.e. a circular orbit, around the drive shaft, which facilitates the opening and closing process.

In an additional configuration of the invention, the tension device can comprise a cable that is wound around, or looped or connected, in the vicinity of the main closing edge of the inner door panel, whereby this cable, which may also be guided around a deflector roller or pulley, is guided to an elastic energy storage device located on the transom or in a similar location. The elastic energy storage device can preferably be a torsion spring. Here again, the return force necessary to open the door panel can be selected to suit the specific requirements by selecting an elastic energy storage device realized in the form of a torsion spring, if the energy storage device can be installed in a suitable location in the vicinity of the transom.

Alternatively, a linear spring element can be used instead of an elastic energy storage mechanism realized in the form of a torsion spring.

In an additional embodiment of the present invention, the swinging folding door can have at least four door panels, at least two of which correspond to one drive shaft, so that the door panels corresponding to the respective drive shafts can be moved in opposite directions.

The present invention has been described above on the basis of a swinging folding door that has one outer door panel and one inner door panel. The invention can also be used analogously on swinging folding doors with door panels that move in the same direction, whereby the corresponding tension or compression means are assigned to the respective left and right drive shafts.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any away admit that the present application does not include more than one patentably and non-obviously distinct invention, and maintains that this application may include more than one patentably and non-obviously distinct invention. The Application hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to possible embodiments that are illustrated schematically in the accompanying drawings, in which.

DESCRIPTION OF PREFERRED EMBODIMENT

Figure 1:
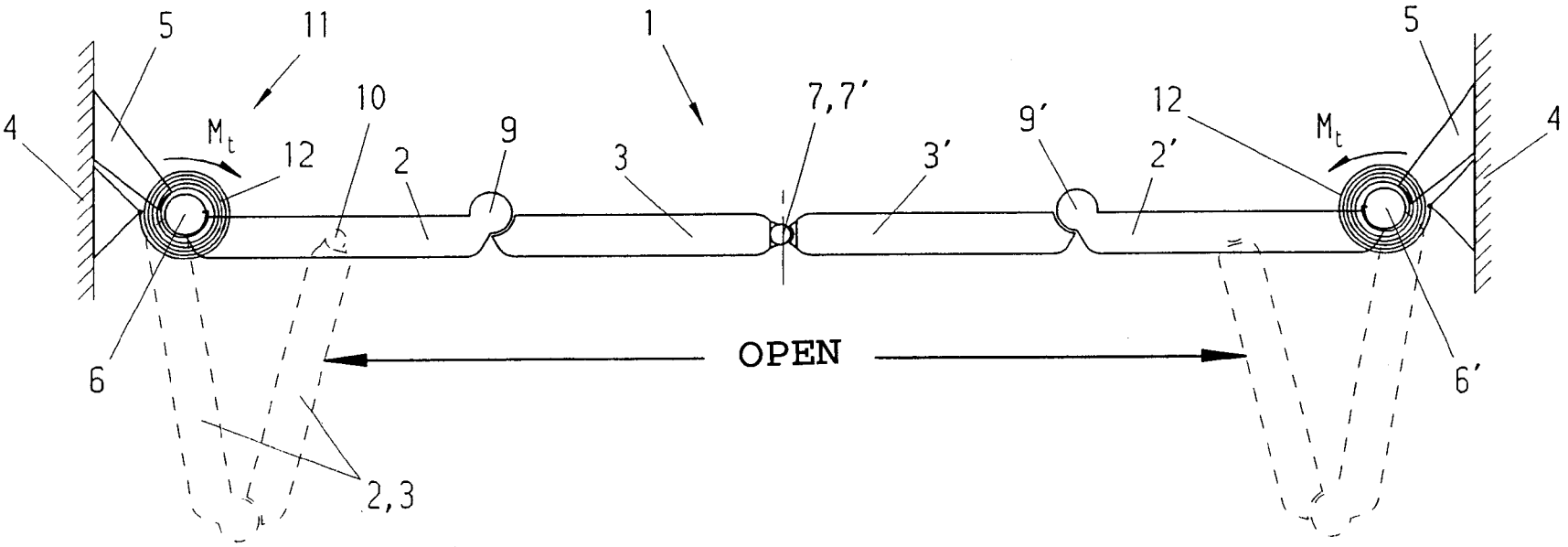
FIGS. 1 and 2 show the door opening as a result of the generation of a torque in the opening direction on the drive shafts of the outer door panels.

FIGS. 1, 2, 3 and 4 illustrate a swinging folding door which is designed 1 in general. FIG. 1A illustrates a schematic view of a drive system for the swinging folding door 1. It is assumed that the opening and closing of door panels 2, 2', 3 and 3' can occur in a known manner by a n electric motor 100 (see FIG. 1A) with a reducing or step-down transmission 103 and a switchable electromagnetic clutch or coupling 101. During the closing of the swinging folding door 1, a pre-load is applied to the tension means that will be explained in detail below, i.e. energy is transmitted to them. When the electric motor 100 is de-energized and the coupling 101 is automatically released, the tension means shown in the embodiments (FIGS. 1–4) move the individual door panels into the open position on account of the energy stored within these tension means.

Additionally, a fire system or sensor system 102 can be provided to disengage the supply of electricity to the electromagnetic clutch 101 in the event of fire or other similar event. This can disengage the electromagnetic clutch or coupling 101 and again allow the swinging folding door 1 to open.

In the figures, the same or similar components are identified by the same reference numbers.

The swinging folding door 1 has two outer door panels 2, 2' and two inner door panels 3, 3'. The outer door panels 2, 2' are mounted by means of brackets 5 on a door frame 4 and can be pivoted around drive shafts 6, 6'. The coupling point 8 of the outer door panel 2, 2' can lie outside the axis of rotation, i.e. the drive shaft 6, 6'. The two door panels 2, 3 and 2', 3' respectively are connected to one another by a drag link 9. The respectively are connected to one another by a drag link 9. The inner door panels 3, 3' are located with their main closing edges 7, 7' facing one another.

Figure 1A:
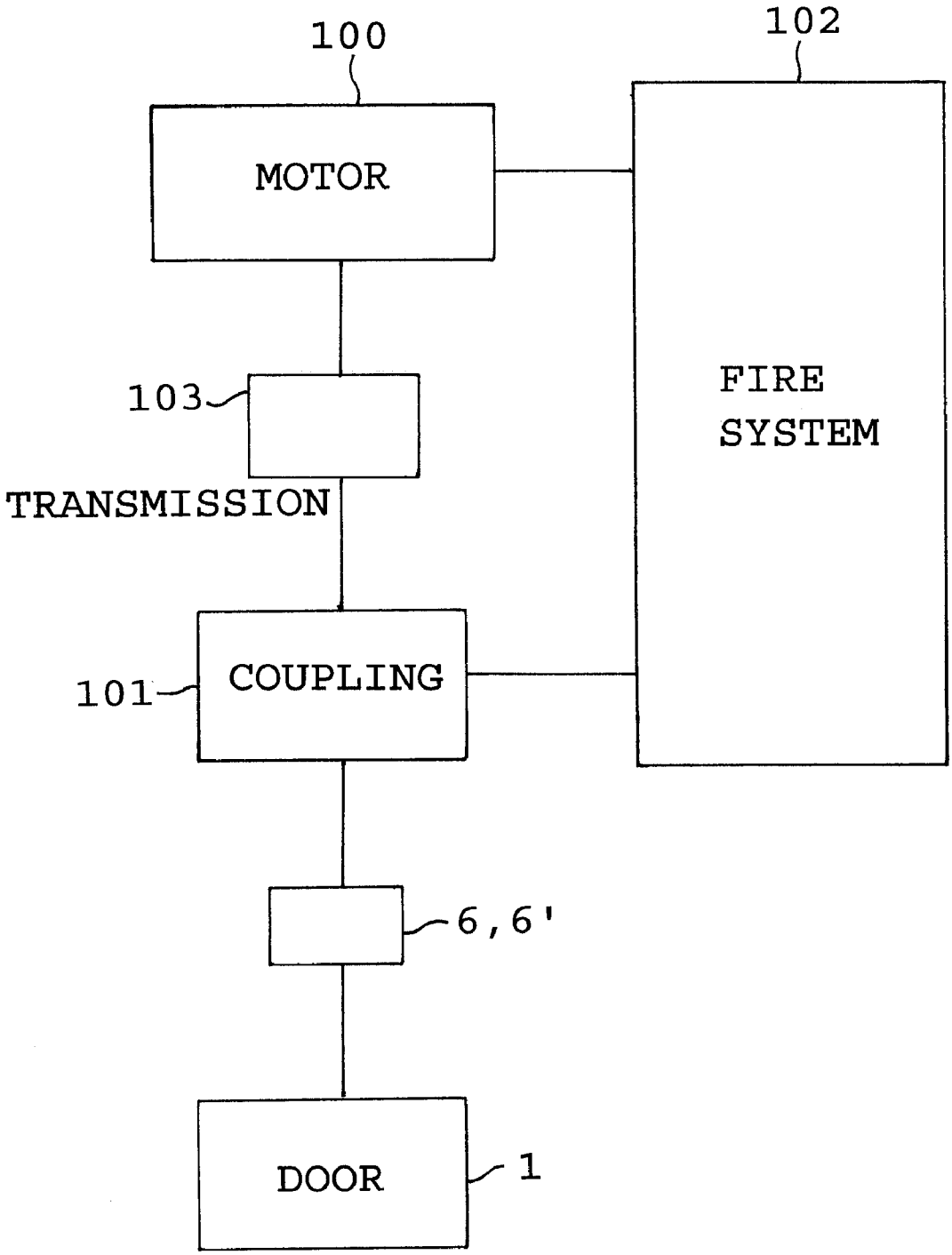
FIG. 1A illustrates a schematic view of the electric drive system connected to the door.

The emergency opening device, which is designed 11 in general in FIG. 1, includes a leg spring mechanism 12 located in or on the drive shaft 6, 6'. As shown in FIG. 1, the leg spring mechanism 12 is realized in the form of a torsion spring, and can exert the torsion moment designated $M_t$ on the outer door panel 2, 2' and thus on the inner door panels 3, 3'. A pre-load can be applied to the leg spring mechanism 12 in the manner described above every time the swinging folding door 1 is closed, so that when the motor is de-energized and the electromagnetic coupling is released, the door panels 2, 3 and 2', 3' respectively are pulled into the open position illustrated in broken lines.

Figure 2:
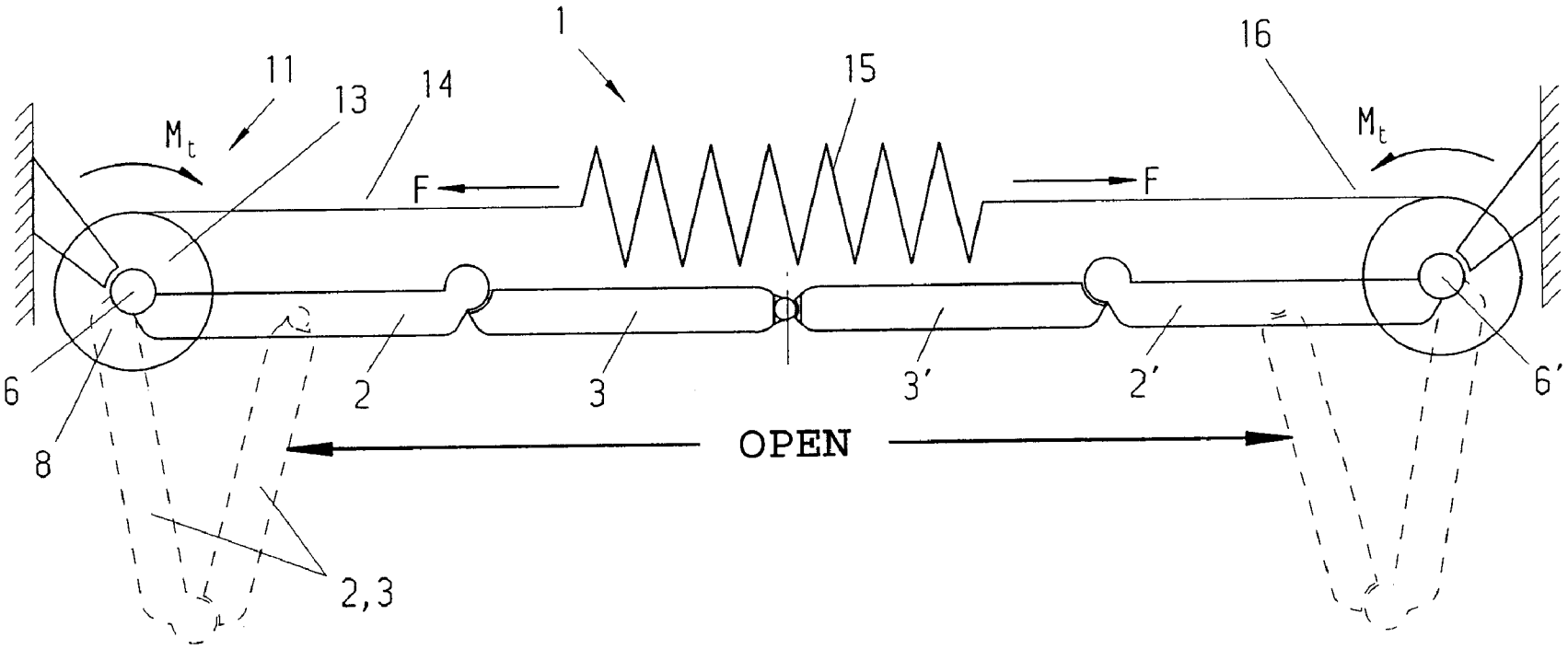

In an embodiment illustrated in FIG. 2, the leg spring mechanism 12 illustrated in FIG. 1 has been replaced by a flat coil spring which is realized in the form of a linearly acting spring element. The flat coil spring 15 transmits the spring force designated F via a linear tension means 14 realized in the form of a cable 16 to a winding roller 13. The winding roller 13 is connected non-rotationally with the drive shaft 6, 6', and thus can move the door panels 2, 3 and 2,', 3' respectively, into the open position illustrated by the broken lines.

Figure 3:
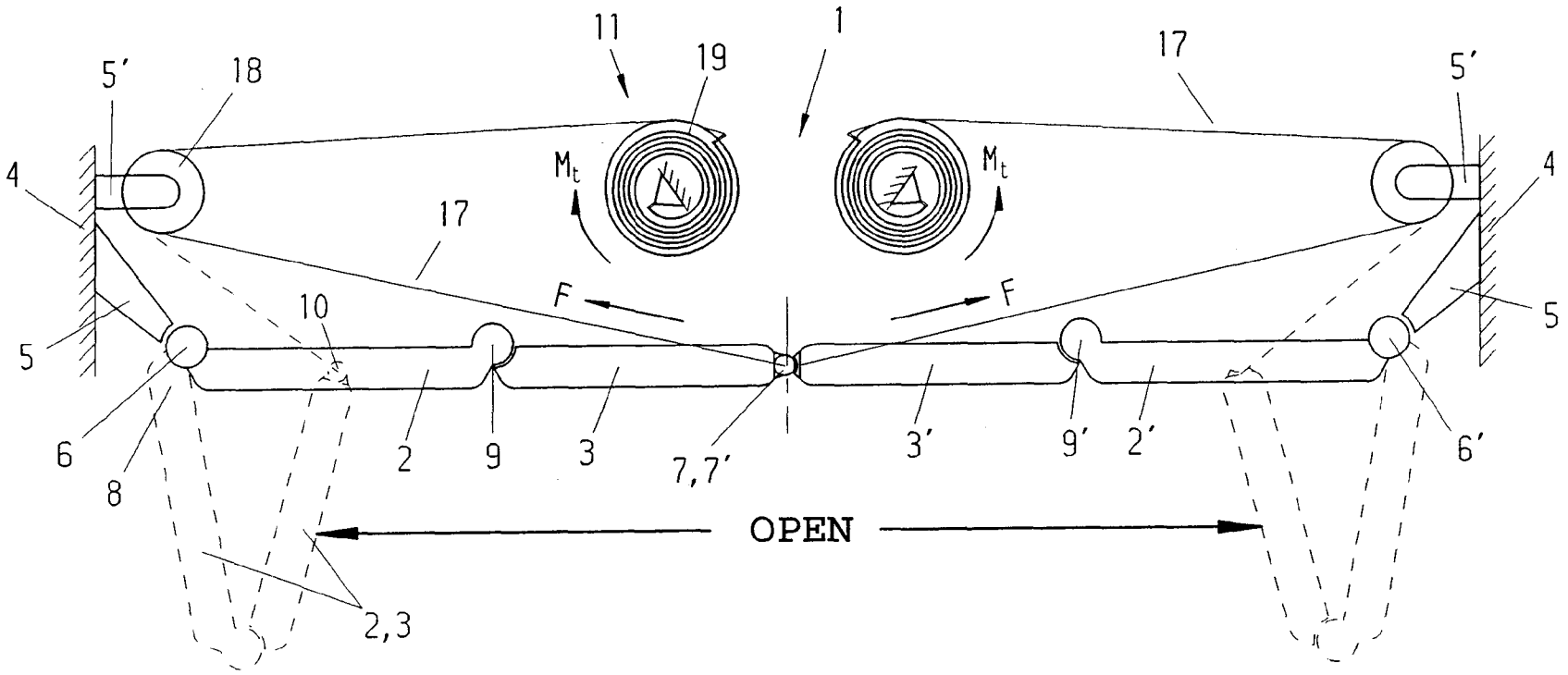
FIGS. 3 and 4 show the door opening as a result of the generation of a force that is applied substantially linearly is the opening direction the vicinity of the closing edge.

An embodiment illustrated in FIG. 3 also uses a cable 17, which cable 17 is guided from the closing edge 7, 7' via a deflector pulley 18 fastened by means of a bracket 5' to the door frame 4. The cable 17 can thus be guided to an elastic energy storage device which is realized in the form of a torsion spring 19. The torsion spring 19 is suitably located in the vicinity of the transom or in a similar location. It is apparent that when the motor is de-energized, the torsion spring 19 is capable of winding the cable 17 up by means of the torsion spring 19 and moving the door panels 2, 3 and 2', 3' respectively into the open position.

Figure 4:
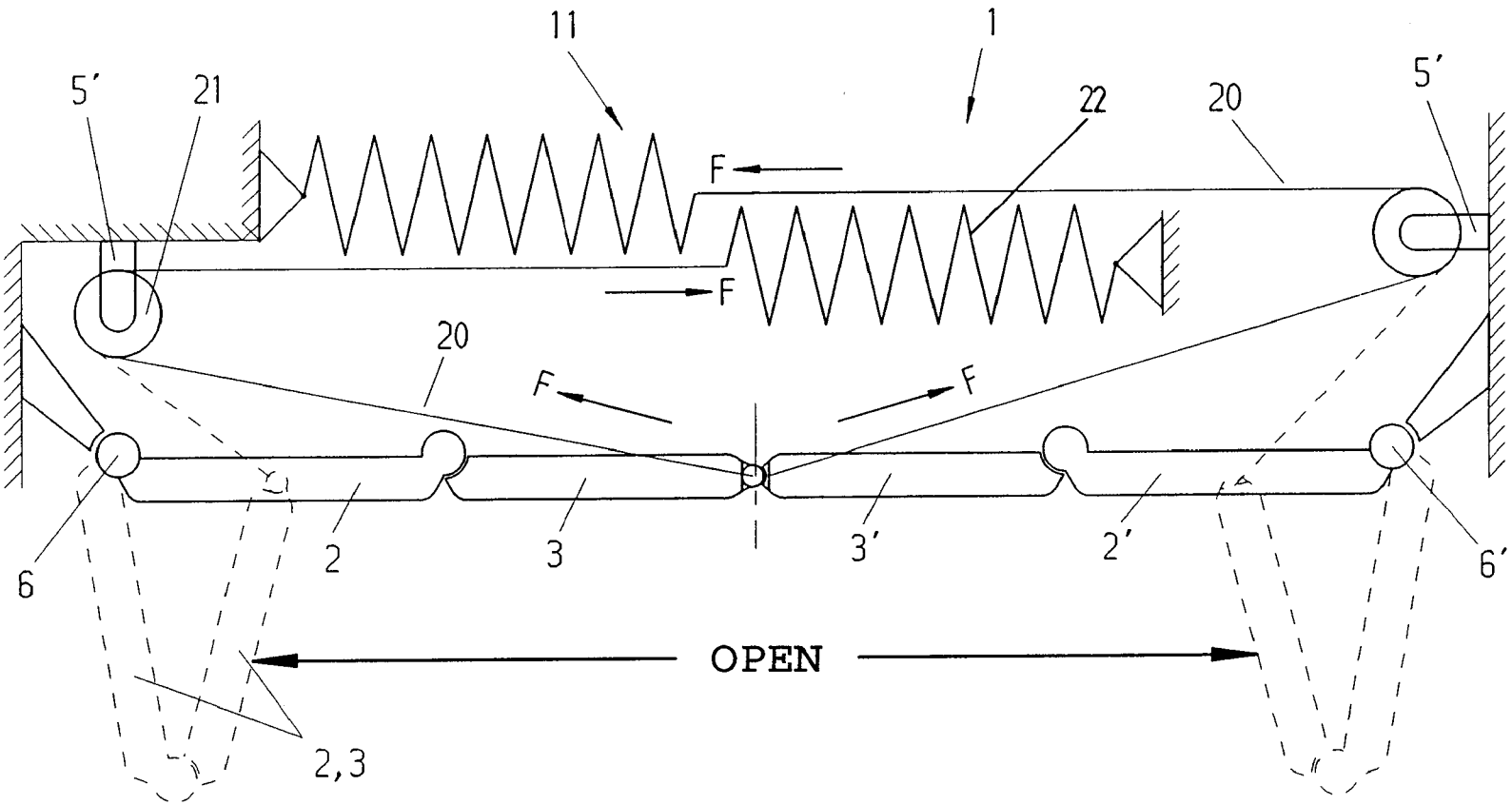

In the embodiment illustrated in FIG. 4, the torsion spring 19 shown in FIG. 3 has been replaced by a linear spring element 22 that acts on a cable 20.

In at least one embodiment of the present invention, a deflector roller 21 can be used to guide the cable 20 with respect to the linear spring element 22.

In the described presented above, it has been assumed that the door panels 3, 3' are guided in a restricted manner in guide elements that are generally schematically designated 10 in the vicinity of the transom and/or the floor, or that folding linkages of the prior art are located at least in the vicinity of the drag links 9, 9' that are located between two door panels.

In at least one embodiment of the present invention, a fire system 102 can be connected to either or both the motor 100 and the coupling 101. This can allow the motor to be deenergized and the coupling to be disengaged in the event of an emergency, and also to allow the door 1 to open.

In other possible embodiments of the present invention, the drive system can comprise a hydropneumatic drive or hydraulic drive. Also, other alternative drive systems for the door can be used. Similarly, the coupling can be replaced with a hydraulic coupling or a pneumatic coupling or other similar type of disengageable coupling device.

Figure 5:
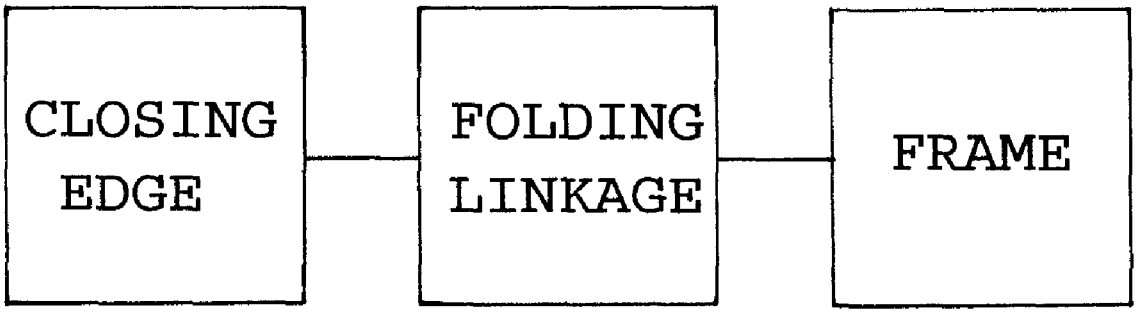
FIG. 5 shows a block diagram of a folding linkage connecting a door edge and frame.

FIG. 5 shows a block diagram of a folding linkage to guide the main closing edge of the door with respect to the door frame upon opening or closing the door.

One feature of the invention resides broadly in the emergency opening device for a swinging folding door that has at least one outer and one inner panel, with at least two panels that are connected to one another by means of a pivoting drag link, whereby an outer panel is guided in a restricted manner in a hinge which is located on the door frame or in a similar location, and the free end of an inner door panel that has a main closing edge is guided in a restricted manner in or on the door frame or case, on the transom or crossbar or in a similar location by means of a folding linkage, characterized by the fact that the hinge forms the drive shaft 6, 6' of the outer door panel 2, 2' and the drive system for the opening and closing of the door panels 2, 2', 3, 3' comprises an electric-motor drive with a switchable electromagnetic coupling and the emergency opening device 11 of an elastic tension or compression means, i.e. a leg spring mechanism 12, flat coil spring 15, torsion spring 19, or linear spring element 22, that can be stretched during the closing of the swinging folding door and is engaged in the drive shaft 6, 6' of the outer door panel 2, 2' or in the vicinity of the main closing edge 7, 7' of the inner door panel 3, 3'.

Another feature of the invention resides broadly in the emergency opening device for a swinging folding gate that has at least one outer and one inner panel, with at least two panels that are connected to one another by means of a pivoting drag link, whereby an outer panel is guided in a restricted manner in a hinge which is located on the gate frame or in a similar location, and the free end of an inner gate panel that has a main closing edge is guided in a restricted manner in or on the gate frame, on the transom or in a similar location by means of a folding linkage, characterized by the fact that the hinge forms the drive shaft 6, 6' of the outer gate panel 2, 2' and the drive system for the opening and closing of the gate panels 2, 2', 3, 3' comprises an electric-motor drive with a switchable electromagnetic coupling and the emergency opening device 11 of an elastic tension or compression means i.e. a leg spring mechanism 12, flat coil spring 15, torsion spring 19, or linear spring element 22, that can be stretched during the closing of the swinging folding gate and is engaged in the drive shaft 6, 6' of the outer gate panel 2, 2' or in the vicinity of the main closing edge 7, 7' of the inner gate panel 3, 3'.

Yet another feature of the invention resides broadly in the emergency opening device characterized by the fact that the tension means are a leg spring mechanism located inside the drive shaft 6, 6' of the outer door panel 2, 2' or gate panel, which drive shaft is located inside the door frame 4 or in a similar location.

Still another feature of the invention resides broadly in the emergency opening device characterized by the fact that the tension means are a leg spring mechanism 12 located concentric to the drive shaft 6, 6' of the outer door panel 2, 2' or gate panel, which drive shaft is located on the door frame 4 or in a similar location.

A further feature of the invention resides broadly in the emergency opening device characterized by the fact that the leg spring mechanism 12 is realized in the form of a flat coil spring or torsion rod.

Another feature of the invention resides broadly in the emergency opening device characterized by the fact that the drive shaft 6, 6' has a winding roller 13 non-rotationally connected to it, which guides a linear tension means 14, the other end of which is connected to a transom or a similar location.

Yet another feature of the invention resides broadly in the emergency opening device characterized by the fact that the linear tension means 14 consist of a cable 16 to which tension can be applied by a flat coil spring 15.

Still another feature of the invention resides broadly in the emergency opening device characterized by the fact that the coupling point 8 of the outer gate or door panel 2, 2' on the drive shaft 6, 6' lies outside the drive shaft 6, 6'.

A further feature of the invention resides broadly in the emergency opening device characterized by the fact that the tension means consist of a cable 17 looped in the vicinity of the main closing edge 7, 7' of the inner gate or door panel 3, 3', which cable 17 is guided by means of a deflector roller or pulley 18 if necessary to an elastic energy storage device located on the transom or in a similar location.

Another feature of the invention resides broadly in the emergency opening device characterized by the fact that the elastic energy storage device is a torsion spring 19.

Yet another feature of the invention resides broadly in the emergency opening device characterized by the fact that the tension means consist of a cable 20 looped in the vicinity of the main closing edge 7, 7' of the inner gate or door panel 3, 3', which cable is guided by means of a deflector roller 21 if necessary to a linear spring element 22 located on the transom or in a similar location.

Still another feature of the invention resides broadly in the emergency opening device characterized by the fact that the swinging folding door 1 has at least four door panels 2, 2', 3, 3', and corresponding to at least each two door panels 2, 3 or 2,', 3' there is a drive shaft 6, 6' located so that the door panels 2, 3 and 2', 3' respectively corresponding to the respective drive shafts 6, 6' can be moved in opposite directions.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment of all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 196 52 600.0, filed on Dec. 18, 1996, having inventor Arne Leibacher, and DE-OS 196 52 600.0 and DE-PS 196 52 600.0 and International Application No. PCT/EP97/06805, filed on Dec. 5, 1997, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Examples of folding doors, and structure associated with folding doors, which may be incorporated in embodiments of the present invention, may be found in the following U.S. Pat. No. 5,392,834, issued Feb. 28, 1995 to Borgardt; U.S. Pat. No. 5,435,372, issued Jul. 25, 1995 to Kikuchi; U.S. Pat. No. 5,392,836, issued Feb. 28, 1995 to West et al.,; U.S. Pat. No. 5,242,005, issued Sep. 7, 1993 to Borgardt; U.S. Pat. No. 5,295,527, issued Mar. 22, 1994 to West; and U.S. Pat. No. 5,301,735, issued Apr. 12, 1994 to Chen.

Examples of automatic doors, and control systems for automatic doors, which may be used in embodiments of the present invention, may be found in the following U.S. Pat. No. 5,443,142, issued Dec. 6, 1993 to Glaser; U.S. Pat. No. 5,453,736, issued Sep. 26, 1995 to Noren; U.S. Pat. No. 5,460,100, issued May 26, 1994 T Gowda et al.; U.S. Pat. No. 5,472,293, issued Dec. 5, 1995 to Roller; U.S. Pat. No. 5,218,282, issued Mar. 22, 1990 to Duhame; U.S. Pat. No. 4,891,911, issued Jan. 9, 1990 to Yung; U.S. Pat. No. 4,994,724, issued Feb. 19, 1991 to Hsu; U.S. Pat. No. 5,004,277, issued Arp. 2, 1991 to Campbell et al.; U.S. Pat. No. 5,083,397, issued Jan. 28, 1992 to Koura; U.S. Pat. No. 5,123,204, issued Jun. 23, 1992 to He; and U.S. Pat. No. 5,144,769, issued Sep. 8, 1992 to Koura.

Examples of electromagnetic clutches or couplings which may be incorporated in embodiments of the present invention, may be found in the following U.S. Pat. No. 5,396,976 issued Mar. 14, 1995 to Koitabashi; U.S. Pat. No. 5,428,431, issued Jun. 27, 1995 to Abe et al.; and U.S. Pat. No. 5,445,259, issued Aug. 30, 1993 to Nelson.

Examples of electric motors which could be incorporated in embodiments of the present invention may be found in the following U.S. Pat. No. 5,197,582, issued Mar. 30, 1993 to Cropley; U.S. Pat. No. 5,251,400 issued Oct. 12, 1993 to Schultze; U.S. Pat. No. 5,300,867 issued Apr. 5, 1994 to Brade et al.; U.S. Pat. No. 5,341,598, issued Aug. 30, 1994 to Reddy; and U.S. Pat. No. 5,374,791 issued Dec. 20, 1994 to LeMarchand.

Examples of rotary couplings for doors which may be incorporated in embodiments of the present invention may be found in the following U.S. Pat. No. 5,386,885 issued on Feb. 2, 1995 to Bunzl et al., U.S. Pat. No. 5,401,104, issued on Mar. 28, 1995 to Newton; U.S. Pat. No. 5,417,011, issued May 23, 1995 to Keszthelyi; U.S. Pat. No. 5,443,109, issued Aug. 22, 1995 to Benthin; and U.S. Pat. No. 5,462,015, issued Jun. 1, 1994 to Murphy.

Examples of drag links which may be incorporated in embodiments of the present invention may be found in the following U.S. Pat. No. 5,419,611, issued May 30, 1995 to Cook; U.S. Pat. No. 5,423,394, issued Jun. 13, 1995 to Kendle; U.S. Pat. No. 5,458,618, issued Oct. 17, 1995 to Steinke; U.S. Pat. No. 5,199,216, issued Apr. 6, 1993 to Vetter et al.; U.S. Pat. No. 5,224,528, issued Jul. 6, 1993 to Helmut et al.; U.S. Pat. No. 5,263,378, issued Nov. 23, 1993 to Loomer; and U.S. Pat. No. 5,305,844, issued Apr. 26, 1994 to Ducote.

The details in the patents, patent applications and publications may be considered to be incorporable, at applicant's option, into the claims during presecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A swinging folding door with an emergency opening device comprising:

a door frame;

two first door panels;

two second door panels;

each of said two first door panels being disposed between said two second door panels;

two first hinge structures being disposed to pivotably link each of said two first door panels to a corresponding one of said two second door panels;

each of said two first door panels comprising a main closing edge, said main closing edges being disposed opposite a corresponding one of said two second door panels;

two second hinge structures, each of said two second hinge structures being configured and disposed to guide a corresponding one of said two second door panels with respect to said door frame;

each of said two second hinge structures comprising a drive shaft to open and close said door;

an electric drive to open and close said door;

an electromagnetic coupling being disposed to connect said electric drive to said drive shaft of each of said two second hinge structures upon power being supplied to said electromagnetic coupling to permit the opening and closing of said door by said drive;

an emergency opening device to open said door upon a loss of power to said electromagnetic coupling;

said emergency opening device comprising:

two leg spring mechanisms being disposed and configured to store energy upon the closing of the door;

each of said two leg spring mechanism being wound and disposed coaxially with and connected to the drive shaft of its corresponding second hinge structure; and said emergency opening device being configured and disposed to automatically open said door with the energy stored in said two leg spring mechanisms upon a loss of power to said electromagnetic coupling;

each of said two second hinge structures having a pivot where said corresponding second door panel pivots with respect to said drive shaft, said pivot being disposed outside of said drive shaft;

said door comprising a linkage to guide said main closing edge of each of said two first door panels with respect to said door frame to fold said door upon opening of said door; and said two second door panels being configured and disposed to pivot in opposite directions about their respective drive shafts.

2. The swinging folding door with an emergency opening device according to claim 1, wherein:

said two first hinge structures each comprise a pivotable drag link; and said door frame comprises a transom.

3. A swinging folding door with an emergency opening device comprising:

a door frame;

two first door panels;

two second door panels;

each of said two first door panels being disposed between said two second door panels;

two first hinge structures being disposed to pivotably link each of said two first door panels to a corresponding one of said two second door panels;

each of said two first door panels comprising a main closing edge, said main closing edges being disposed opposite a corresponding one of said two second door panels;

two second hinge structures, each of said two second hinge structures being configured and disposed to guide a corresponding one of said two second door panels with respect to said door frame;

each of said two second hinge structures comprising a drive shaft to pen and close said door;

an electric drive to open and close said door;

an electromagnetic coupling being disposed to connect said electric drive to said drive shaft of each of said two second hinge structures upon power being supplied to said electromagnetic coupling to permit the opening and closing of said door by said drive;

an emergency opening device to open said door upon a loss of power to said electromagnetic coupling;

said emergency opening device comprising:

a coil spring mechanism being configured to store energy upon the closing of the door;

two winding rollers;

each of said two winding rollers being non-rotationally connected to and coaxially disposed with the drive shaft of its corresponding second hinge structure; and said coil spring mechanism being connected to each of said two winding rollers to transfer force to each of said two winding rollers and thus to each of said drive shafts to open said door upon a loss of power to said electromagnetic coupling;

each of said two second hinge structures having a pivot where said corresponding second door panel pivots with respect to said drive shaft, said pivot being disposed outside of said drive shaft;

said door comprising a linkage to guide said main closing edge of each of said two first door panels with respect to said door frame to fold said door upon opening of said door; and said two second door panels being configured and disposed to pivot in opposite directions about their respective drive shafts.

4. The swinging folding door with an emergency opening device according to claim 3, wherein said emergency opening device comprises two cables configured and disposed to connect said coil spring mechanism to each of said two winding rollers.

5. The swinging folding door with an emergency opening device according to claim 4, wherein:

said two first hinge structures each comprise a pivotable drag link; and said door frames comprises a transom.

6. A swinging folding door with an emergency opening device comprising:

a door frame;

two first door panels;

two second door panels;

each of said two first door panels being disposed between said two second door panels;

two first hinge structures being disposed to pivotably link each of said two first door panels to a corresponding one of said two second door panels;

each of said two first door panels comprising a main closing edge, said main closing edges being disposed opposite a corresponding one of said two second door panels;

two second hinge structures, each of said two second hinge structures being configured and disposed to guide a corresponding one of said two second door panels with respect to said door frame;

each of said two second hinge structures comprising a drive shaft to open and close said door;

an electric drive to open and close said door;

an electromagnetic coupling being disposed to connect said electric drive to said drive shaft of each of said two second hinge structures upon power being supplied to said electromagnetic coupling to permit the opening and closing of said door by said drive;

an emergency opening device to open said door upon a loss of power to said electromagnetic coupling;

said emergency opening device comprising:

a spring mechanism being configured to store energy upon the closing of the door;

two pulleys;

each of said two pulleys being mounted a distance away from said two second hinge structures;

said spring mechanism being disposed a substantial distance away from said two pulleys;

two cables;

each of said two cables having a first end and a second end;

said first end of each of said two cables being connected to said spring mechanism;

said second end of each of said two cables being connected to a corresponding one of said two first panels adjacent said main closing edge;

each of said two cables having a portion between said first end and said second end disposed about a corresponding one of said two pulleys;

said spring mechanism being connected to each of said two first panels to transfer force to each of said two first panels to open said door upon a loss of power to said electromagnetic coupling;

each of said two second hinge structures having a pivot where said corresponding second door panel pivots with respect to said drive shaft, said pivot being disposed outside of said drive shaft;

said door comprising a linkage to guide said main closing edge of each of said two first door panels with respect to said door frame to fold said door upon opening of said door; and said two second door panels being configured and disposed to pivot in opposite directions about their respective drive shafts.

7. The swinging folding door with an emergency opening device according to claim 6, wherein said spring mechanism comprises two coil springs.

8. The swinging folding door with an emergency opening device according to claim 7, wherein:

each of said two coil springs comprising a first end and a second end;

said first end of each of said two coil springs is connected to a corresponding one of said two cables; and said second end of each of said two coil springs is connected to said door frame.

9. The swinging folding door with an emergency opening device according to claim 8, wherein:

said two first hinge structures each comprise a pivotable drag link; and said door frame comprising a transom.

10. The swinging folding door with an emergency opening device according to claim 6, wherein said spring mechanism comprises two wound springs.

11. The swinging folding door with an emergency opening device according to claim 10, wherein:

each of said two wound springs is connected to a corresponding one of said two cables; and each of said two wound springs is connected to said door frame.

12. The swinging folding door with so emergency opening device according to claim 11, wherein:

said two first hinge structures each comprise a pivotable drag link; and said door frame comprises a transom.

* * * * *

UNITED STATES PATENT AND TRADEMARK OFFICE

CERTIFICATE OF CORRECTION

PATENT NO. : 6,283,189 B1
DATED : September 4, 2001
INVENTOR(S) : Arne Liebscher It is certified that error appears in the above-identified patent and that said Letters Patent is hereby corrected as shown below:

Column 1,
Line 11, after “Dec.”, delete “6,” and substitute -- 5, --.

Column 2,
Line 33, after “other”, delete “eventually.” and substitute -- eventuality. --.
Line 56, after “edge”, delete “o” and substitute -- of --.

Column 3,
Line 8, after “which”, delete “drives” and substitute -- drive --.
Line 63, after “The”, delete “Applica-” and substitute -- Applicant --.
Line 64, before “hereby” delete “tion”.

Column 4,
Line 19, after “is”, delete “designed” and substitute -- designated --.
Line 49, after “9.” delete “The respectively are connected to one another by a drag link 9.”
Line 52, after “is”, delete “designed” and substitute -- designated --.

Column 5,
Line 24, after “the”, delete “described” and substitute -- description --.

Column 7,
Line 20, after “embodiment”, delete “of” and substitute -- or --.
Line 29, after “Arne”, delete “Leibacher,” and substitute -- Liebscher, --.
Line 53, after “1994”, delete “T” and substitute -- to --.

UNITED STATES PATENT AND TRADEMARK OFFICE

CERTIFICATE OF CORRECTION

PATENT NO. : 6,283,189 B1
DATED : September 4, 2001
INVENTOR(S) : Arne Liebscher It is certified that error appears in the above-identified patent and that said Letters Patent is hereby corrected as shown below:

Column 9,
Line 14, after “spring”, delete “mechanism” and substitute -- mechanisms --.
Line 60, after “to”, delete “pen” and substitute -- open --.

Signed and Sealed this

Twenty-fourth Day of December, 2002

JAMES E. ROGAN
*Director of the United States Patent and Trademark Office*